US011732544B2

(12) United States Patent
Elliott et al.

(10) Patent No.: US 11,732,544 B2
(45) Date of Patent: Aug. 22, 2023

(54) DISSOLVABLE PLUGS USED IN DOWNHOLE COMPLETION SYSTEMS

(71) Applicant: NexGen Oil Tools Inc., Three Rivers, TX (US)

(72) Inventors: Dane Elliott, Pawnee, TX (US); Alfred Moseley, Mobile, AL (US); Travis Jack Power, Houston, TX (US)

(73) Assignee: NexGen Oil Tools Inc., Three Rivers, TX (US)

( * ) Notice: Subject to any disclaimer, the term of this patent is extended or adjusted under 35 U.S.C. 154(b) by 0 days.

(21) Appl. No.: 17/725,323

(22) Filed: Apr. 20, 2022

(65) Prior Publication Data

US 2022/0243551 A1 Aug. 4, 2022

Related U.S. Application Data

(63) Continuation of application No. 16/840,792, filed on Apr. 6, 2020, now Pat. No. 11,313,198.

(60) Provisional application No. 62/834,585, filed on Apr. 16, 2019.

(51) Int. Cl.
*E21B 33/12* (2006.01)
*E21B 29/02* (2006.01)
*E21B 23/04* (2006.01)

(52) U.S. Cl.
CPC ..... *E21B 33/12* (2013.01); *E21B 29/02* (2013.01); *E21B 23/0413* (2020.05)

(58) Field of Classification Search
CPC ..... E21B 33/12; E21B 29/02; E21B 23/0413; E21B 2200/08; E21B 33/134
See application file for complete search history.

(56) References Cited

U.S. PATENT DOCUMENTS 1,932,427 A * 10/1933 Stone ..... E21B 17/08 285/334
3,895,829 A * 7/1975 Manson, Jr. ..... E21B 17/043 285/333
3,924,677 A * 12/1975 Prenner ..... E21B 43/11 166/100
4,712,815 A * 12/1987 Reeves ..... F16L 15/003 285/379
4,732,416 A * 3/1988 Dearden ..... E21B 17/042 285/333
4,813,717 A * 3/1989 Watts ..... E21B 17/042 285/333
4,944,345 A * 7/1990 Mashaw, Jr. ..... E21B 23/02 166/217
4,955,644 A * 9/1990 Pfeiffer ..... F16L 15/001 285/333
5,165,473 A * 11/1992 Bode ..... E21B 33/16 292/318
5,289,884 A * 3/1994 Johnstone ..... E21B 33/08 166/387
5,383,692 A * 1/1995 Watts ..... F16L 15/001 264/296

(Continued)

*Primary Examiner* — Steven A Macdonald

(74) *Attorney, Agent, or Firm* — Vorys, Sater, Seymour and Pease LLP

(57) ABSTRACT

A completion assembly includes an upper liner and a lower liner, a wellbore completion component that interposes the upper and lower liners, a dissolvable pipe plug secured within an aperture defined in the wellbore completion component, and a dissolvable projectile seat arranged adjacent the wellbore completion component.

13 Claims, 4 Drawing Sheets

(56) References Cited

U.S. PATENT DOCUMENTS 10,030,472 B2 * 7/2018 Fripp ..... E21B 43/12
2002/0088744 A1 * 7/2002 Echols ..... E21B 43/108 210/85
2004/0069489 A1 * 4/2004 Corbett ..... E21B 43/045 166/278
2006/0118296 A1 * 6/2006 Dybevik ..... E21B 17/18 166/370
2008/0135249 A1 * 6/2008 Fripp ..... E21B 43/088 166/65.1
2008/0302538 A1 * 12/2008 Hofman ..... E21B 43/00 166/373
2009/0095471 A1 * 4/2009 Guignard ..... E21B 34/14 166/278
2011/0247833 A1 * 10/2011 Todd ..... E21B 34/063 166/228
2013/0032357 A1 * 2/2013 Mazyar ..... E21B 34/063 166/376
2013/0206425 A1 * 8/2013 Mazyar ..... E21B 23/04 166/376
2014/0034308 A1 * 2/2014 Holderman ..... E21B 43/12 166/279
2014/0116725 A1 * 5/2014 Wollmann ..... E21B 17/042 166/242.6
2014/0138097 A1 * 5/2014 Andrigo ..... E21B 21/10 166/373
2015/0192001 A1 * 7/2015 Hall ..... E21B 43/08 166/205
2016/0123116 A1 * 5/2016 Randle ..... E21B 17/006 166/243
2016/0208575 A1 * 7/2016 Bellavance ..... E21B 34/063
2017/0356266 A1 * 12/2017 Arackakudiyil ..... E21B 47/06
2018/0087369 A1 * 3/2018 Sherman ..... G01N 33/24
2018/0328139 A1 * 11/2018 Mhaskar ..... E21B 34/063
2018/0363453 A1 * 12/2018 Canning ..... E21B 34/06
2019/0203563 A1 * 7/2019 Gano ..... E21B 43/08
2020/0095845 A1 * 3/2020 Watkins ..... E21B 33/1208

* cited by examiner

DISSOLVABLE PLUGS USED IN DOWNHOLE COMPLETION SYSTEMS

BACKGROUND

In the oil and gas industry, wellbores are typically drilled in a near vertical orientation from the surface with a rotatory drilling rig. The rig utilizes a drill bit attached to drill pipe to penetrate the earth and a drilling mud system is operated to return cuttings to the surface. The drill bit may be steered with measure-while drilling (MWD) or rotary steering systems, as is common to the drilling industry. In some wellbores, a horizontal portion is drilled from the vertical portion to penetrate more surface area of a hydrocarbon-bearing formation. After drilling the wellbore, all or a portion of the wellbore may be lined with casing or a liner, which may be cemented in place to stabilize the wellbore and prevent corrosion of the casing or liner.

Horizontal wellbores are sometimes completed by installing a completion system, which can include a toe initiator system arranged at the end or "toe" of the horizontal wellbore. Horizontal wellbore completions are designed to drain the formation at a constant rate along horizontal production zones, and the toe initiator system operates to open pathways through the casing or liner from the surrounding subterranean formation. This type of production prevents high draw down by utilizing multiple entry points along the horizontal production zone. Horizontal completions also lead to lower sand production, borehole collapse, water coning, and a higher recovery of reserves.

Prior to initiating hydrocarbon production, the casing or liner must be perforated and the surrounding formation may be hydraulically fractured to increase the permeability of the surrounding rock formations. One common method to perforate and hydraulically fracture multiple zones in wellbore horizontal sections is referred to as a "plug and perf" hydraulic fracturing job. Holes or ports can be formed (punched) in the casing or liner that lines the wellbore by lowering one or more perforating guns into the wellbore on wireline, coiled tubing, or threaded pipe. Perforating guns use shaped charges that are detonated to pierce the liner, cement, and the surrounding formation in a single shot.

Once holes are formed in the casing or liner, the surrounding formations may then be hydraulically fractured or "fracked" through the holes. Hydraulic fracturing entails pumping a viscous fracturing fluid downhole under high pressure and injecting the fracturing fluid into adjacent hydrocarbon-bearing formations to create, open, and extend formation fractures. Fracturing fluids usually contain propping agents, commonly referred to as "proppant," that flow into the fractures and hold or "prop" open the fractures once the fluid pressure is reduced. Propping the fractures open enhances permeability by allowing the fractures to serve as conduits for hydrocarbons trapped within the formation to flow to the wellbore. Once a production zone has been hydraulically fractured, a wellbore isolation device, such as a bridge plug or "frac" plug, may be set within the wellbore above the treated production zone to isolate that zone. The operation then moves uphole and the process is repeated multiple times working from the toe of the well towards the heel.

The "plug and perf" method relies on an open hydraulic pathway from the casing or liner to the formation in order to pump the tools down the wellbore. Initially there are no holes, ports, or pathway when the casing or liner is run to bottom of the well, cemented into place, and the liner hanger is set. The casing or liner must be sealed and holding pressure, otherwise the cement would return into the inner bore of the liner. A tool is needed to open a fluid pathway between the liner and formation to allow the perforating guns or frac plugs to be pumped down. If a fluid pathway is not provided, the tools may experience hydraulic lock during its descent.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
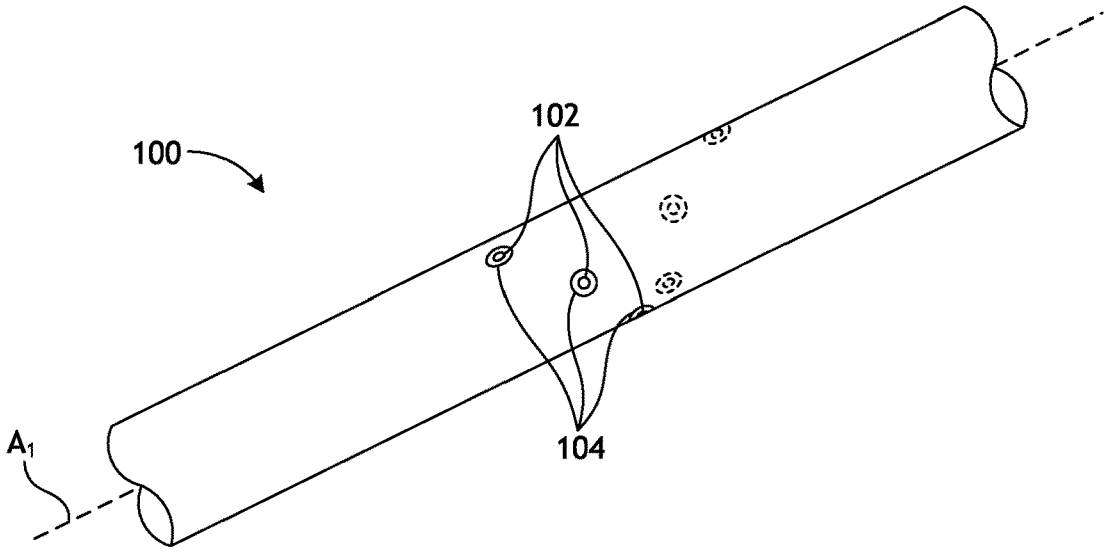
FIG. 1 is an isometric side view of an example wellbore completion component that may incorporate one or more of the principles of the present disclosure.

The present disclosure is related to downhole operations in the oil and gas industry and, more particularly, to dissolvable pipe plugs used in wellbore completion systems.

The pipe plugs described in conjunction with the presently disclosed systems may be made of or comprise a degradable or dissolvable material. The terms "degradable" and "dissolvable" will be used herein interchangeably. The term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions (including electrochemical reactions), thermal reactions, or reactions induced by radiation. In some instances, the degradation of the material may be sufficient for the mechanical properties of the material to be reduced to a point that the material no longer maintains its integrity and, in essence, falls apart or sloughs off. The conditions for degradation or dissolution are generally wellbore conditions where an external stimulus may be used to initiate or effect the rate of degradation. For example, the pH of the fluid that interacts with the material may be changed by the introduction of an acid or a base.

The degradation rate of a given dissolvable material may be accelerated, rapid, or normal, as defined herein. Accelerated degradation may be in the range of from a lower limit of about 30 minutes, 1 hour, 2 hours, 3 hours, 4 hours, 5 hours, and 6 hours to an upper limit of about 12 hours, 11 hours, 10 hours, 9 hours, 8 hours, 7 hours, and 6 hours, encompassing any value or subset therebetween. Rapid degradation may be in the range of from a lower limit of about 12 hours, 1 day, 2 days, 3 days, 4 days, and 5 days to an upper limit of about 10 days, 9 days, 8 days, 7 days, 6 days, and 5 days, encompassing any value or subset therebetween. Normal degradation may be in the range of from a lower limit of about 12 days, 13 days, 14 days, 15 days, 16 days, 17 days, 18 days, 19 days, 20 days, 21 days, 22 days, 23 days, 24 days, 25 days, and 26 days to an upper limit of about 40 days, 39 days, 38 days, 37 days, 36 days, 35 days, 34 days, 33 days, 32 days, 31 days, 30 days, 29 days, 28 days, 27 days, and 26 days, encompassing any value or subset therebetween. Accordingly, degradation of the dissolvable material may be between about 30 minutes to about 40 days, depending on a number of factors including, but not limited to, the type of dissolvable material selected, the conditions of the wellbore environment, and the like.

Suitable dissolvable materials that may be used in accordance with the embodiments of the present disclosure include dissolvable metals, galvanically-corrodible metals, degradable polymers such as polyglycolic acid (PGA) and polylactic acid (PLA), degradable rubbers, borate glass, dehydrated salts, and any combination thereof. Suitable dissolvable materials may also include pH-sensitive materials that undergo degradation upon an appropriate chemical stimuli, including an epoxy resin exposed to a caustic solution, fiberglass exposed to an acid, aluminum exposed to an acidic fluid, and a binding agent exposed to a caustic or acidic solution. The dissolvable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the dissolvable material of aqueous or hydrocarbon fluids present within the wellbore environment such that the mechanical properties of the dissolvable material degrade or fail. In degradation by swelling, the dissolvable material continues to absorb the aqueous and/or hydrocarbon fluid until its mechanical properties are no longer capable of maintaining the integrity of the dissolvable material and it at least partially falls apart. In some embodiments, the dissolvable material may be designed to only partially degrade by swelling in order to ensure that the mechanical properties of the component formed from the dissolvable material is sufficiently capable of lasting for the duration of the specific operation in which it is utilized.

Example aqueous fluids that may be used to swell and degrade the dissolvable material include, but are not limited to, fresh water, saltwater (e.g., water containing one or more salts dissolved therein), brine (e.g., saturated salt water), seawater, acid, bases, or combinations thereof. Example hydrocarbon fluids that may swell and degrade the dissolvable material include, but are not limited to, crude oil, a fractional distillate of crude oil, a saturated hydrocarbon, an unsaturated hydrocarbon, a branched hydrocarbon, a cyclic hydrocarbon, and any combination thereof.

Degradation by dissolving involves a dissolvable material that is soluble or otherwise susceptible to an aqueous fluid or a hydrocarbon fluid, such that the aqueous or hydrocarbon fluid is not necessarily incorporated into the dissolvable material (as is the case with degradation by swelling), but becomes soluble upon contact with the aqueous or hydrocarbon fluid.

Degradation by undergoing a chemical change may involve breaking the bonds of the backbone of the dissolvable material (e.g., a polymer backbone) or causing the bonds of the dissolvable material to crosslink, such that the dissolvable material becomes brittle and breaks into small pieces upon contact with even small forces expected in the wellbore environment.

Degradation by thermal degradation involves chemical decomposition of a dissolvable material with thermal energy or heat, such elevated temperatures that might be present in a wellbore environment. Thermal degradation of some dissolvable materials mentioned or contemplated herein may occur at wellbore environment temperatures that exceed about 93° C. (or about 200° F.).

Degradation by galvanic corrosion involves an electrochemical process in which one or more metals corrode when in electrical contact with another type of metal and both metals are immersed in an aqueous fluid (e.g., water, brine, or other salt-containing fluids). When two or more different kinds of metals come into contact with each other in the presence of an aqueous fluid, a galvanic pair may be formed due to the different electrode potentials of the different metals. The aqueous medium provides a means for ion migration whereby metallic ions can move from the anode to the cathode of the galvanic pair.

The pipe plugs and other wellbore tool components described herein can be constructed, partially or entirely, from one or more galvanically-corrodible metals. In some embodiments, the pipe plugs may be made of two or more dissimilar materials or an alloy of materials that form a galvanic pair resulting in galvanic corrosion of the pipe plug by itself. In such embodiments, the pipe plug may begin degrading in the presence of an aqueous or hydrocarbon fluid present within a downhole environment.

In other embodiments, however, the pipe plugs may galvanically corrode as coupled to a pipe or tubular in the presence of an aqueous or hydrocarbon fluid present within a downhole environment. In such embodiments, electrochemical degradation is initiated when the separate elements are placed within proximity of one another. For example, a pipe or tubular may include a cylindrical body constructed from a first galvanically-corrodible metal and having one or more apertures threadably receiving one or more pipe plugs constructed from a second galvanically-corrodible metal that forms a galvanic pair with the first metal. As the pipe plug is exposed to an aqueous fluid, such as a connate or injected fluid, galvanic corrosion begins and the pipe plugs begin to degrade.

Suitable dissolvable or galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Suitable galvanically-corrodible metals also include a nano-structured matrix galvanic materials. One example of a nano-structured matrix micro-galvanic material is a magnesium alloy with iron-coated inclusions. Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic pairing between these different domains, which causes micro-galvanic corrosion and degradation. Micro-galvanically corrodible magnesium alloys could also be solution structured with other elements such as zinc, aluminum, nickel, iron, carbon, tin, silver, copper, titanium, rare earth elements, et cetera. Micro-galvanically corrodible aluminum alloys could be in solution with elements such as nickel, iron, carbon, tin, silver, copper, titanium, gallium, et cetera. Of these galvanically-corrodible metals, magnesium and magnesium alloys may be preferred.

With respect to degradable polymers used as a dissolvable material, a polymer is considered "degradable" or "dissolvable" if the degradation is due to chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(ε-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof.

Polyanhydrides are another type of particularly suitable degradable polymer useful in the embodiments of the present disclosure. Polyanhydrides hydrolyze in the presence of aqueous fluids to liberate the constituent monomers or comonomers, yielding carboxylic acids as the final degradation products. The erosion time can be varied over a broad range of changes to the polymer backbone, including varying the molecular weight, composition, or derivatization. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the dissolvable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the dissolvable material forming the component may be any amount that confers a desirable elasticity without affecting the desired amount of degradation. In some embodiments, the thermoplastic polymer may be included in an amount in the range of a lower limit of about 1%, 5%, 10%, 15%, 20%, 25%, 30%, 35%, 40%, and 45% to an upper limit of about 91%, 85%, 80%, 75%, 70%, 65%, 60%, 55%, 50%, and 45% by weight of the dissolvable material, encompassing any value or subset therebetween.

FIG. 1 is an isometric side view of an example wellbore completion component 100 that may incorporate one or more of the principles of the present disclosure. The wellbore completion component 100 may be or otherwise comprise any cylindrical or tubular structure, tool, or component that may be used in a downhole completion. Example wellbore completion components 100 include, but are not limited to, wellbore tubing, casing, intermediate casing, casing equipment, liner, a pup joint, a coupling, a centralizer, a float shoe, a cement shoe, and any combination thereof. The wellbore completion component 100 may be used in vertical or horizontal sections of a wellbore, without departing from the scope of the disclosure.

In the illustrated embodiment, the wellbore completion component 100 comprises a length of wellbore tubing, such as casing, liner, or a pup joint, and may form part of a downhole completion system, such as a toe initiator system. As illustrated, one or more pipe plugs 102 may be coupled to the wellbore completion component 100. One or more holes or apertures 104 may be defined in the outer circumference of the wellbore completion component 100 to receive the pipe plugs 102. In some embodiments, one or more of the pipe plugs 102 may be threadably received within the corresponding apertures 104. In other embodiments, however, one or more of the pipe plugs 102 may be secured within corresponding apertures 104 by other means, such as, but not limited to, an interference or shrink fit, an adhesive, welding, brazing, or any combination thereof.

In some embodiments, as illustrated, the apertures 104 may be defined in a spiral or helical pattern about the circumference of the wellbore completion component 100 such that the pipe plugs 102 are both axially and angularly offset from each other along a longitudinal axis Ai of the wellbore completion component 100. As will be appreciated, this may prove advantageous in helping retain the pressure integrity of the wellbore completion component 100 by reducing hoop stress in the wellbore completion component 100 and maintaining tensile loading factors.

Figure 2A:
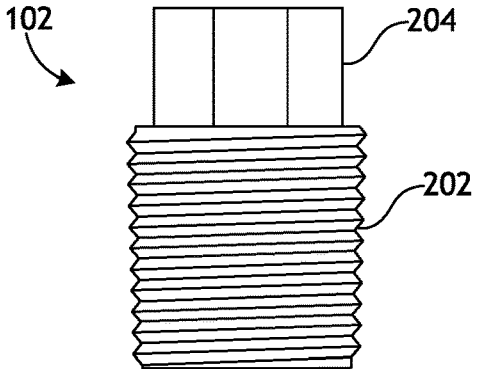
FIGS. 2A and 2B are side and top views, respectively, of an example pipe plug, according to one or more embodiments.
Figure 2B:
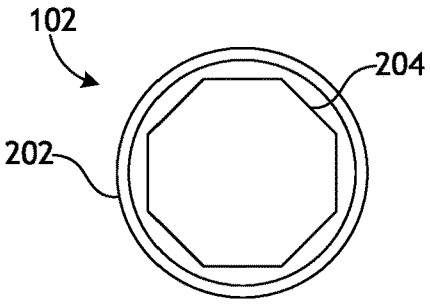

FIGS. 2A and 2B are side and top views, respectively, of an example pipe plug 102, according to one or more embodiments. Each pipe plug 102 may be made of any of the dissolvable materials mentioned herein. In at least one embodiment, the pipe plug 102 may be made of a dissolvable metal, such as a magnesium alloy that may dissolve in water (fresh or salt), but not in the presence of hydrocarbons. In the illustrated embodiment, the pipe plug 102 has a tapered sealable thread 202 and a head 204 on top that allows torque to be applied to the pipe plug 102 during installation. The head 204 can exhibit a hexagonal cross-section, but could alternatively exhibit any other cross-sectional shape, without departing from the scope of the disclosure.

In some embodiments, as briefly mentioned above, the pipe plug 102 may be constructed from two or more dissimilar materials or an alloy containing a galvanic pair capable of undergoing galvanic corrosion. In other embodiments, the pipe plug 102 may be constructed of a first galvanically-corrodible metal and the wellbore completion component 100 (FIG. 1) in which the pipe plug 102 is installed may be constructed of a second galvanically-corrodible metal that forms a galvanic pair with the first material.

In some embodiments, after the pipe plug 102 is installed in the wellbore completion component 100 (FIG. 1), the head 204 may be removed by cutting or grinding to be flush with the outer surface of the wellbore completion component 100. In other embodiments, the pipe plug 102 may be advanced into the corresponding aperture 104 (FIG. 1) until the head 204 reaches a depth recessed from the outer surface of the wellbore completion component 100. In such embodiments, a seal (e.g., an O-ring seal) may create controlled dissolution of the pipe plug 102 that first forms a small hole or nozzle in the center of the plug 102. This may help injection operations by making a more predictable breakthrough, erosion of the plug 102 if not fully dissolved, and better injection.

Figure 3:
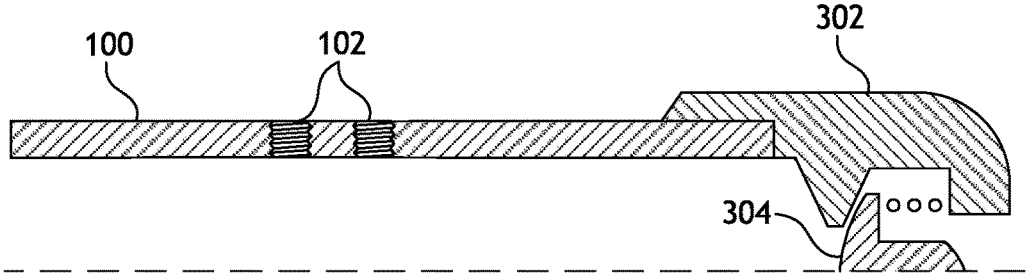
FIG. 3 is a cross-sectional side view of an example installation of the wellbore completion component of FIG. 1.

FIG. 3 is a cross-sectional side view of an example installation of the wellbore completion component 100, according to one or more embodiments. In the illustrated embodiment, the wellbore completion component 100 comprises wellbore tubing, such as casing, liner, or a pup joint used to line the walls of a drilled wellbore and forming part of a toe initiator system. As illustrated, the wellbore completion component 100 may be positioned or otherwise installed adjacent a float shoe 302 arranged at or near the bottom (end) of the toe initiator system.

In the illustrated embodiment, the float shoe 302 has a check valve 304 that permits fluid flow inside the wellbore completion component 100 to exit the wellbore completion component 100 via the float shoe 302, while simultaneously preventing fluids present outside the float shoe 302 to enter the wellbore completion component 100. The check valve 304 may comprise, for example a poppet type, a flapper type, or a sleeve type valve. In the illustrated embodiment, the pipe plugs 102 are installed in the sidewall of the wellbore completion component 100, but could alternatively be attached to the float shoe 302, in a joint adjacent the float shoe 302 (e.g., a pup joint), in a joint above the float shoe 302, or anywhere along a liner or casing designed to be perforated for hydraulic fracturing.

Figure 4:
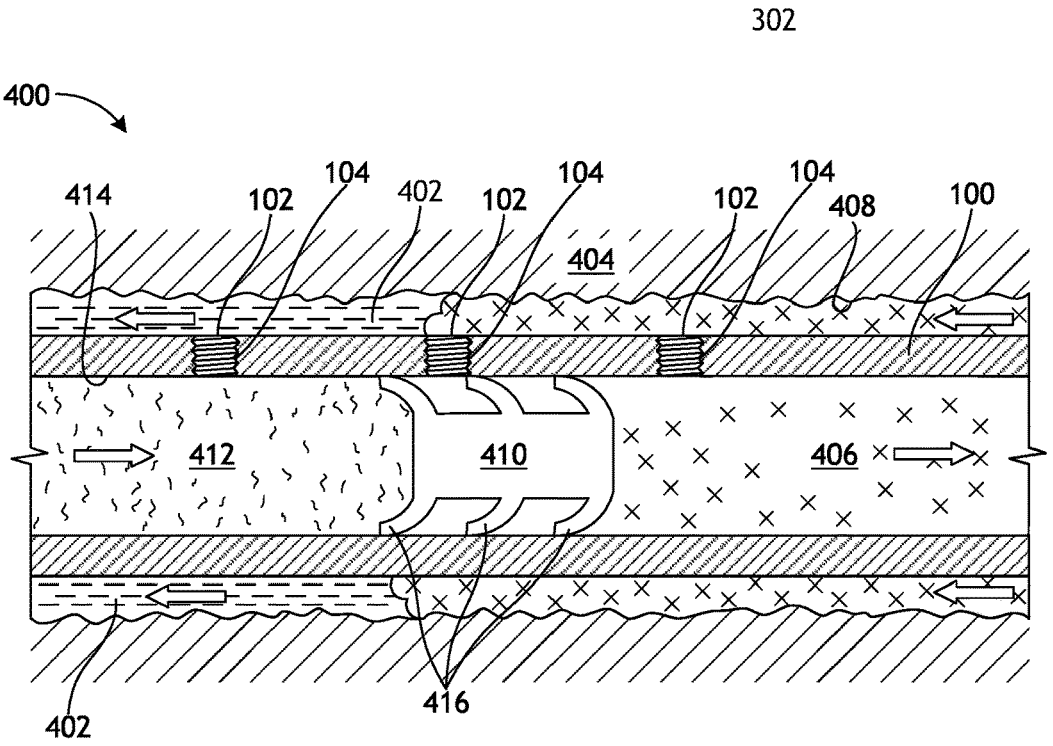
FIG. 4 is a cross-sectional side view of an example wellbore showing example operation of the wellbore completion component, according to one or more embodiments of the disclosure.

FIG. 4 is a cross-sectional side view of a horizontal section of an example wellbore 400 showing example operation of the wellbore completion component 100, according to one or more embodiments of the disclosure. In the illustrated embodiment, the wellbore completion component 100, including any associated liner and/or casing, may be lowered into the wellbore 400 while circulating a fluid, such as a drilling fluid 402 (e.g., an oil-based mud). Because of their chemical make-up, the dissolvable pipe plugs 102 will not begin to dissolve or erode in the presence of the oil-based drilling fluid 402 unless water has entered the wellbore 400 from the adjacent subterranean formation 404. Accordingly, the absence of water in the wellbore 400 may preserve the integrity of the pipe plugs 102.

A liner hanger (not shown) will anchor the wellbore completion component 100 to the casing or liner near the bottom of the primary (vertical) casing string. The wellbore 400 is cemented with a cement slurry 406 while the wellbore completion component 100 (and any associated liner and/or casing) is reciprocated or rotated to induce turbulence, wellbore cleaning, and remove voids in the cement slurry 406. A first wiper plug (not shown) may be released into the wellbore 400 and deployed downhole to separate the drilling fluid 402 from the cement 406. Accordingly, pumping the cement 406 into the wellbore 400 may pump the first wiper plug to the toe of the well. Once the first wiper plug reaches the toe, a burst disk in the first wiper plug may be ruptured to allow the cement 406 to flow into the annulus 408 defined between the outer diameter of the wellbore completion component 100 and the inner wall of the wellbore 400.

A second wiper plug 410 may then be released behind the cement 406 and pumped downhole with a spacer fluid 412, such as brine water. In some embodiments, the spacer fluid 412 may include a cement retarder, such as sugar, boric acid, or another suitable chemical that prevents the cement 406 that remains along the inner surface 414 of the wellbore completion component 100, inside couplings, and other equipment from hardening. The wiper plug 410 may be generally constructed of a thermoplastic core with flexible thermoplastic or elastomer fins 416 that seal against the inner surface 414 of the wellbore completion component 100 while simultaneously wiping or removing all or a portion of the cement 406 as it traverses interior of the wellbore completion component 100. In thinner wellbore completion components 100, the dissolvable pipe plugs 102 may slightly protrude past the inner surface 414 of the wellbore completion component 100. In thicker wellbore completion components 100, the dissolvable pipe plugs 102 may be recessed away from the inner surface 414.

In operation, the wiper plug 410 will be pumped downhole and past the dissolvable pipe plugs 102. Once the wiper plug 410 passes, the dissolvable pipe plugs 102 will be exposed to the cement 406 on the outer surface 418 of the wellbore completion component 100 and the spacer fluid 412 on the inside surface 414. The water content of the cement 406 and the spacer fluid 412 may help dissolve or degrade the dissolvable pipe plugs 102. In some embodiments, the pipe plugs 102 will have pressure-holding integrity for 24 to 48 hours while dissolving, depending on the material alloy, the well temperature, and the salinity of the spacer fluid 412.

After the wiper plug 410 reaches the casing float shoe 302 (FIG. 3) at the end of the toe initiator system, the liner hanger may be set and the wellbore 400 may be cleaned of excess cement 406. The cement 406 typically takes about 4-8 hours or up to about 24 hours to harden within the annulus 408, depending on the well depth, temperature, and cement blend. The wellbore 400 may be pressure tested after the cement 406 has hardened and before the well can be hydraulically fractured. A positive pressure test means the well has been properly cemented, the wiper plug 410 is holding pressure, the liner hanger is properly set, and a liner hanger packer is holding pressure. A negative test means that a leak path has developed and must be repaired or otherwise the subsequent hydraulic fracture treatment will exit the leak path instead of into the production zone of interest. While dissolving at a predetermined rate, the dissolvable pipe plugs 102 are holding pressure during the pressure test.

After the well has been pressure tested and the pipe plugs 102 have dissolved, the operator will pressure up the well to fracture through the hardened cement 406 at the location of the apertures 104 and simultaneously expend any remaining material from the pipe plugs 102. The application of hydraulic pressure fractures the surrounding formation 404, and thereby creates cracks, fractures, and pathways through which fluids may flow to the wellbore 400. The operator may now pump the first stage of proppant through the open apertures 104, now referred to as "ports."

Alternatively, after the well has been pressure tested and the pipe plugs 102 have dissolved, one or more sets of perforating guns (not shown) may be pumped into the wellbore 400 to create additional ports in the wellbore completion component 100. As will be appreciated, with the pipe plugs 102 fully or partially dissolved, the perforating guns can be pumped into the wellbore 400 and the open apertures 104 may help prevent hydraulic lock as the advancing perforating guns force fluids out of the wellbore 400 through the apertures 104 and into the surrounding formation 404.

Figure 5:
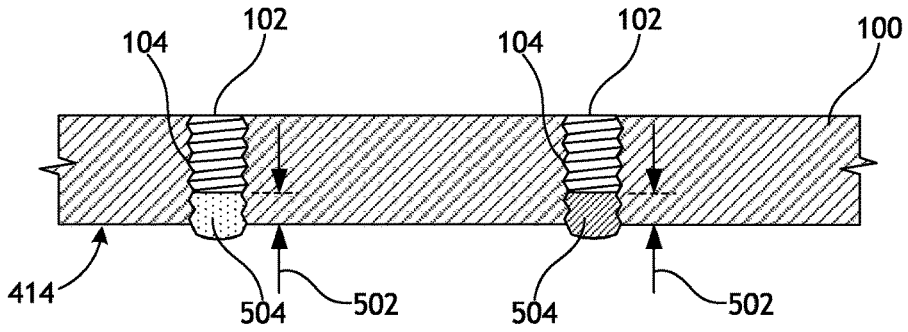
FIG. 5 is an enlarged, cross-sectional side view of a portion of the wellbore completion component of FIG. 1, according to one or more embodiments.

FIG. 5 is an enlarged, cross-sectional side view of a portion of the wellbore completion component 100, according to one or more embodiments. In some embodiments, the dissolvable pipe plugs 102 may be recessed from the inner surface 414 of the wellbore completion component 100 such that a gap or cavity 502 is defined between the end of the pipe plug 102 and the inner surface 414. More particularly, the wall thickness of the wellbore completion component 100 may vary based on mill specifications, which may deliver a thicker body. Alternatively, or in addition thereto, the dissolvable pipe plug 102 may not be as long as the threaded aperture 104, thus forming the cavity 502 at the bottom of the aperture 104 when installed into the wellbore completion component 100.

In one or more embodiments, a filler material 504 may be positioned within the cavity 502 to prevent the cavity 502 from being filled with the oil-based drilling fluid 402 (FIG. 4), the cement 406 (FIG. 4), or a combination of both after the wiper plug 410 (FIG. 4) bypasses the pipe plugs 102. The filler material 504 may comprise a coating on the bottom of the pipe plug 102 or a tablet or slug of material arranged in the cavity 502 or otherwise extending from the bottom of the pipe plug 102. In some applications, the filler material 504 may protrude out of the aperture 104 or may alternatively be recessed within the aperture 104. In embodiments where the filler material 504 is recessed into the aperture 104, circulating the spacer fluid 412 (FIG. 4) may flush out any cement 406 that may become lodged in the aperture 104 below the filler material 504.

In some embodiments, the filler material 504 may be made of a material that will not degrade or dissolve in the presence of the oil-based drilling fluid 402 (FIG. 4), but may dissolve in the presence of the cement 406 (FIG. 4) or the spacer fluid 412 (FIG. 4). In other embodiments, or in addition thereto, the filler material 504 may be configured to help prolong degradation of the pipe plug 102 from the bottom of the pipe plug 102. Consequently, in at least one embodiment, the filler material 504 may comprise any of the afore-mentioned dissolvable materials. The filler material 504 may be made of a dissolvable material that degrades at a rate that is faster or slower than that of the pipe plug 102. Other suitable materials for the filler material 504 include, but are not limited to, a TEFLON™, a coating, a wax, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, and any combination thereof.

In some embodiments, the dissolvable pipe plug 102 may be composed of two or more material alloy combinations to facilitate fast or slow dissolving rates. More specifically, the dissolvable pipe plug 102 may be composed of a non-dissolving core or shell that is A) heavier than brine or B) lighter than brine. If the material is heavier than brine (i.e., the spacer fluid 412 of FIG. 4), the core would fall out into the interior of the wellbore completion component 100 upon dissolution of the pipe plug 102, but if the material is lighter than brine, the core would float up and into the annulus 408 (FIG. 4) upon dissolution of the pipe plug 102. In one or more embodiments, the dissolvable pipe plug 102 may comprise an inner portion made of a water degradable material and an outer portion made of a salt-water resistant material. Once the inner material degrades, the outer material no longer forms a seal and allows communication to/from the surrounding formations. In such embodiments, the outer material essentially operates as a shield, and could be a coating applied to the inner portion.

Alternatively, or in addition thereto, the pipe plug 102 may be made of dissimilar metals that generate a galvanic coupling that either accelerates or decelerates the degradation rate of the pipe plug 102. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the dissolvable material. In such embodiments, the degradation rate of the dissolvable material may be decelerated until the sacrificial anode is dissolved or otherwise corroded away.

In some embodiments, all or a portion of the outer surface of the pipe plug 102 may be treated to impede degradation. For example, the outer surface of the pipe plug 102 may undergo a treatment that aids in preventing the dissolvable material from dissolving. Suitable treatments include, but are not limited to, an anodizing treatment, an oxidation treatment, a chromate conversion treatment, a dichromate treatment, a fluoride anodizing treatment, a hard anodizing treatment, or any combination thereof. Some anodizing treatments may result in an anodized layer of material being deposited on the outer surface of the pipe plug 102. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, anodized coating, soft anodized coating, hard anodized coating, electroless nickel plating, ceramic coatings, carbide beads coating, plastic coating, thermal spray coating, high velocity oxygen fuel (HVOF) coating, a nano HVOF coating, a metallic coating, or any combination thereof.

In some embodiments, all or a portion of the outer surface of the pipe plug 102 may be treated or coated with a substance configured to enhance degradation of the dissolvable material. Such a treatment or coating may be configured to remove a protective coating or treatment or otherwise accelerate the degradation of the dissolvable material of the pipe plug 102. One example is a galvanically-corroding metal material coated with a layer of PGA. In this example, the PGA would undergo hydrolysis and cause the surrounding fluid to become more acidic, which would accelerate the degradation of the underlying metal. In other embodiments, the pipe plug 102 may be coated with a temperature-based material. In yet other embodiments, an electrolyte may be built into an alloy that makes up the pipe plug 102, either on the outer part of the pipe plug 102 to speed initial degradation or on the inner portions to delay initial degradation.

Figure 6:
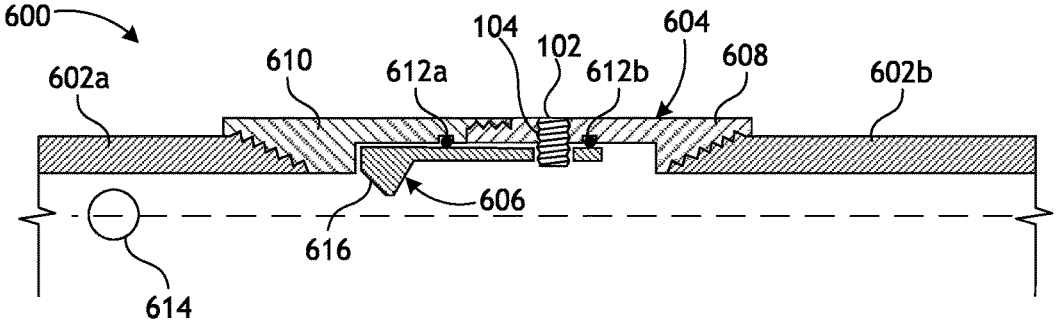
FIG. 6 is a cross-sectional side view of an example completion assembly, according to one or more embodiments.

FIG. 6 is a cross-sectional side view of an example completion assembly 600, according to one or more embodiments. As illustrated, the completion assembly (hereafter the "assembly 600") includes an upper liner 602*a*, a lower liner 602*b*, and a wellbore completion component 604 that interposes the upper and lower liners 602*a,b*. In the illustrated embodiment, the wellbore completion component 604 comprises a coupling or coupling housing that threadably couples the lower liner 602*b* to the upper liner 602*a*. The upper and lower liners 602*a,b* may comprise liner joints, but may otherwise include any type of casing, liner, tubing, or pipe commonly used to line a wellbore in the oil and gas industry.

The assembly 600 may further include a sliding sleeve 606 that may be held in a first position by a dissolvable pipe plug 102 threaded into a lower housing 608 of the wellbore completion component 604. In the illustrated embodiment, the lower liner 602*b* is threaded into the lower housing 608, and the upper liner 602*a* is threaded into an upper housing 610 of the wellbore completion component 604. In other embodiments, however, the lower liner 602*b* may alternatively be welded to the lower housing 608, and the upper liner 602*a* may alternatively be welded to the upper housing 610. As illustrated, the upper housing 610 may be threaded to the lower housing 608 and the sliding insert 606 may extend between or otherwise span the two housings 608, 610.

A first seal 612*a* may be included in the assembly 600 to provide a sealed interface between the sliding insert 606 and the upper housing 610. Similarly, a second seal 612*b* may be included in the assembly 600 to provide a sealed interface between the sliding insert 606 and the lower housing 608. The first and second seals 612*a,b* may comprise any seal or sealing element known in the oil and gas industry including, but not limited to, an O-ring, a wiper ring, a T-seal, or any combination thereof. The dissolvable pipe plug 102 is sealed by a metal-to-metal sealing thread to the lower housing 608, and the assembly 600 holds pressure until the dissolvable pipe plug 102 dissolves in a water-based fluid.

The assembly 600 allows the well to be cemented and pressure tested after the cement 406 (FIG. 4) hardens. The dissolvable pipe plug 102 will begin dissolving after the wiper plug 410 (FIG. 4) passes with the spacer fluid 412 (FIG. 4) behind it. The dissolvable pipe plug 102 will dissolve in 24 to 48 hours, and thus leaving an open aperture 104 or "port." The surrounding cement 406 can then be fractured by applied hydraulic pressure from the surface.

After the pipe plug 102 dissolves and the aperture 104 is exposed, the sliding insert 606 may be moved to occlude and seal the aperture 104. This can be accomplished, for example, by dropping a wellbore projectile 614, such as a ball, a dart, or another type of projectile, from the surface and pumping the wellbore projectile 614 to the assembly 600 to engage a projectile seat 616 defined on an uphole end of the sliding insert 606. The wellbore projectile 614 will sealingly engage the projectile seat 616 by applied hydraulic pressure, and the force of the applied pressure will cause the sliding insert 606 to move into a second or "sealing" position where the aperture 104 (e.g., port) is occluded and closed by the sliding insert 606. In some embodiments, the wellbore projectile 614 may be made of any of the dissolvable materials mentioned herein and may thus be designed to dissolve after a predetermined amount of time. In at least one embodiment, for instance, the wellbore projectile 614 may be made of the same dissolvable material as the dissolvable pipe plug 102.

Figure 7:
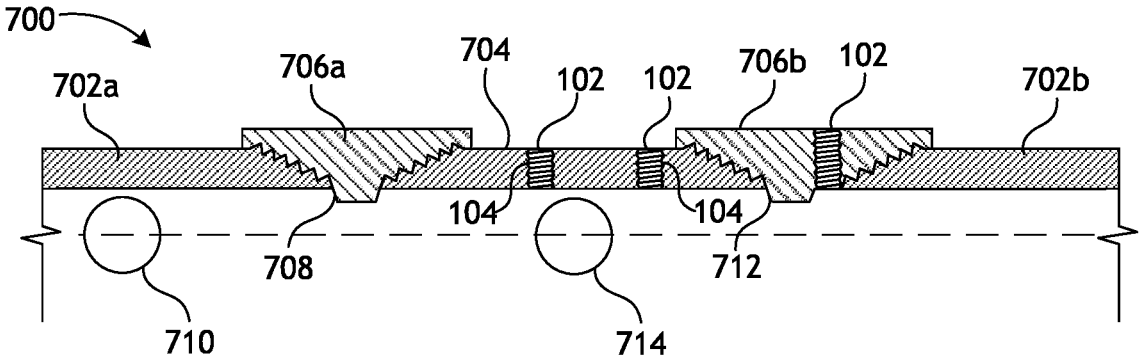
FIG. 7 is a cross-sectional side view of another example completion assembly, according to one or more additional embodiments.

FIG. 7 is a cross-sectional side view of another example completion assembly 700, according to one or more embodiments. As illustrated, the completion assembly (hereafter the "assembly 700") includes an upper liner 702*a*, a lower liner 702*b*, a wellbore completion component 704 that extends between the upper and lower liners 702*a,b*, an upper coupling 706*a*, and a lower coupling 706*b*. In the illustrated embodiment, the wellbore completion component 704 comprises a pup-joint, the upper coupling 706*a* threadably couples the upper liner 702*a* to the wellbore completion component 704, and the lower coupling 706*b* threadably couples the lower liner 702*b* to the wellbore completion component 704.

One or more pipe plugs 102 may be coupled to the wellbore completion component 704, and the upper coupling 706*a* may provide or otherwise define a projectile seat 708 arranged uphole from the pipe plugs 102. The projectile seat 708 arranged uphole from the pipe plugs 102 may help facilitate a method of isolating the downhole portions of the assembly 700 in the event the dissolvable plugs 102 fail to hold pressure or prematurely dissolve. In such embodiments, a wellbore projectile 710, such as a ball, a dart or another type of projectile, may be dropped from surface to locate and sealingly engage the projectile seat 708. The projectile seat 708 may also allow a well operator to isolate flow to get a pressure test after the pipe plugs 102 dissolve, or in case of failure and to isolate the resulting ports 104 to treat the stage without a frac plug (or something similar).

In the illustrated embodiment, the lower coupling 706*b* may further provide or otherwise define a second projectile seat 712, and a pipe plug 102 may also be threaded into the lower coupling 706*b*. The pipe plug 102 in the lower coupling 706*b* may be longer than the pipe plugs 102 arranged in the wellbore completion component 704 and, as a result, may exhibit a longer degradation time. Once the pipe plug 102 in the lower coupling 706*b* dissolves, a pathway from the inner diameter of the tubing to the cement on the outside of the lower coupling 706*b* may open. A second wellbore projectile 714 can be dropped from surface to sealingly engage the second projectile seat 712.

Figure 8:
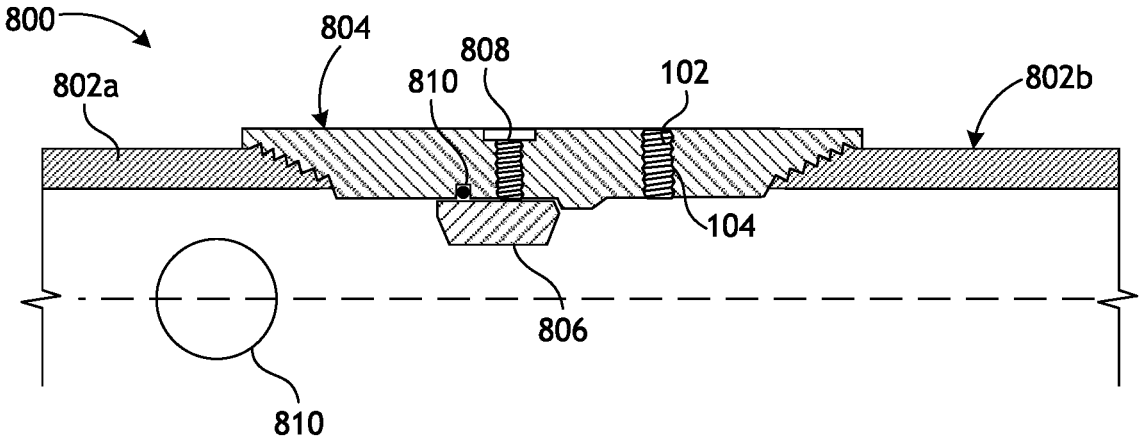
FIG. 8 is a cross-sectional side view of another example completion assembly, according to one or more additional embodiments.

FIG. 8 is a cross-sectional side view of another example completion assembly 800, according to one or more embodiments. As illustrated, the completion assembly (hereafter the "assembly 800") includes an upper liner 802*a*, a lower liner 802*b*, and a wellbore completion component 804 that interposes the upper and lower liners 802*a,b*. In the illustrated embodiment, the wellbore completion component 804 comprises a coupling that threadably couples the lower liner 802*b* to the upper liner 802*a*. The assembly 800 also includes a dissolvable pipe plug 102 threaded into the wellbore completion component 804. The dissolvable pipe plug 102 uses a thread with a metal-to-metal seal as is commonly known in the oilfield industry.

The assembly 800 may further include a projectile seat 806 secured to the wellbore completion component 804 with a threaded fastener 808 and optionally sealed to the wellbore completion component 804 with a seal 810. The threaded fastener 808 may have a thread with a metal-to-metal seal or another sealing element (not shown). In some embodiments, the projectile seat 806 and the threaded fastener 808 may be dissolvable and otherwise made of any of the dissolvable materials mentioned herein. In at least one embodiment, one or both of the projectile seat 806 and the threaded fastener 808 may be made of the same material as the dissolvable pipe plug 102.

In operation, the assembly 800 may be made up adjacent to the float shoe 302 (FIG. 3) and ran to the bottom (toe) of the well. The upper and lower liners 802*a,b* may be cemented into place with the cement 406 (FIG. 4) followed by the wiper plug 410 (FIG. 4) and the spacer fluid 412 (FIG. 4). The wiper plug 410 may be sized to pass through the projectile seat 806 and seal against the float shoe 302, as generally described above. The cement 406 will react with the dissolvable pipe plug 102 and dissolvable projectile seat 806 to begin the dissolving process. The spacer fluid 412 will also react with the dissolvable pipe plug 102 and the dissolvable projectile seat 806 from inside the assembly 800 to dissolve the material of each component. In some embodiments, the projectile seat 806 may be alloyed or otherwise coated to dissolve at a slower rate. The upper and lower liners 802*a,b* may be pressure tested after the cement 406 cures. The pipe plug 102 may be designed to dissolve after the cement 406 cures and the well has been pressure tested. Once the pipe plug 102 dissolves, the well may then be pressured up to pump fluid through the now-exposed apertures 104, and hydraulic pressure and fluid opens a pathway (e.g., cracks, fissures, etc.) through the surrounding rock formations.

A wellbore projectile 810 can be dropped from surface if the well fails the pressure test. The wellbore projectile 810 will land on the projectile seat 806 and thereby isolate the pipe plug 102 and potentially leaky aperture 104 below. The well can then be pressure tested again to diagnose the location of a potential leak. The wellbore projectile 810 may be a wiper plug or similar wellbore projectile to seal against the projectile seat 806. The wellbore projectile 810 may be made of a metal, a thermoplastic, or a combination of materials. In other embodiments, the wellbore projectile 810 may be made of a dissolvable material, and in such embodiments the dissolvable projectile seat 806 and the wellbore projectile 810 will dissolve and leave the wellbore unrestricted.

As will be appreciated, the assembly 800 may be used in multiple locations from the toe to the heel of the horizontal section of a wellbore with progressively larger projectile seats. The size and length of the dissolvable pipe plug 102 can be varied to extend the length of time needed to dissolve. In at least one embodiment, the projectile seat 806 could be coated with a dissolvable elastomer material to aid in sealing against the wellbore projectile 810 and to protect against erosion damage from proppant slurry passing therethrough.

Figure 9:
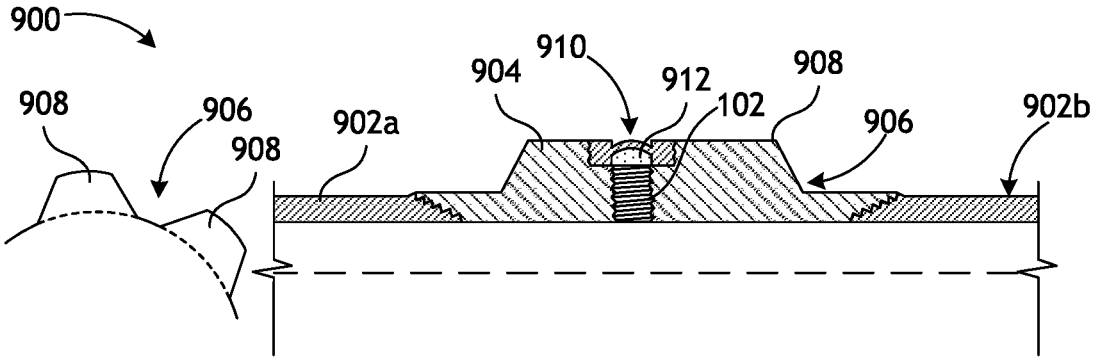
FIG. 9 depicts an end view and a cross-sectional side view of another example completion assembly, according to one or more additional embodiments.

FIG. 9 depicts an end view (left) and a cross-sectional side view (right) of another example completion assembly 900, according to one or more additional embodiments. As illustrated, the completion assembly (hereafter the "assembly 900") includes an upper liner 902*a*, a lower liner 902*b*, and a wellbore completion component 904 that interposes and connects the upper and lower liners 902*a,b*. In the illustrated embodiment, the wellbore completion component 904 comprises a ribbed sub coupling that threadably couples the lower liner 902*b* to the upper liner 902*a*. The assembly 900 also includes a dissolvable pipe plug 102 threaded into the wellbore completion component 904.

The wellbore completion component 904 defines a plurality of channels or cutouts 906 that interpose ribs 908, similar to a solid centralizer or spirolizer, as is known in the oil and gas industry. The cutouts 906 may prove advantageous in allowing the cement 406 (FIG. 4) flow past the wellbore completion component 904 on the outer surface.

The assembly 900 may further include a shield 910, which may comprise any device or structure that provides a barrier between the dissolvable pipe plug 102 and the surrounding environment or the interior of the wellbore completion component 904. The shield 910 may be radially aligned with the dissolvable pipe plug 102. In some embodiments, for example, the shield 910 may be attached to the wellbore completion component 904 above (i.e., radially outward from) the dissolvable pipe plug 102. In other embodiments, however, the shield 910 may be attached to the wellbore completion component 904 below (i.e., radially inward from) the dissolvable pipe plug 102. In yet other embodiments, the assembly 900 may include two shields 910 positioned above and below the pipe plug 102.

The shield 910 may be coupled to the wellbore completion component 904 in a variety of ways. In the illustrated embodiment, for example, the shield 910 is threaded to the wellbore completion component 904. In other embodiments, however, shield 910 may alternatively be welded to the wellbore completion component 904, without departing from the scope of the disclosure. In yet other embodiments, the shield may be press-fit or glued into an orifice defined in the wellbore completion component 904.

In one or more embodiments, the shield 910 may comprise a rupture disc. In such embodiments, the shield 910 may help protect the dissolvable pipe plug 102 from physical damage or damage caused by fluids circulating within the surrounding annulus. The shield 910 will open (burst) when at least a portion of the pipe plug 102 dissolves and high pressure is applied within the assembly 900 from surface. In other embodiments, the shield 910 may comprise a seal (e.g., a one-way seal). In such embodiments, the shield 910 may prevent flow in to contact the pipe plug 102, but not out, and the shield 910 may be hydraulically or mechanically opened.

In some embodiments, coupling the shield 910 to the wellbore completion component 904 may define a gap 912 between the shield 910 and the dissolvable pipe plug 102. In some embodiments, the gap 912 may be filled with a tracer material. In such embodiments, once the shield 910 is ruptured, the tracer material may be discharged into the formation when the casing or liner is cemented in place. If the shield 910 does not open, the tracer will be flowed back to surface from within the casing or liner to verify that the plugs have dissolved. Accordingly, the tracer may be detected at surface during flow-back, and it may be advantageous to have the tracer as close to the point of entry through the wellbore as possible so an operator can determine where the tracer is heading.

Figure 10:
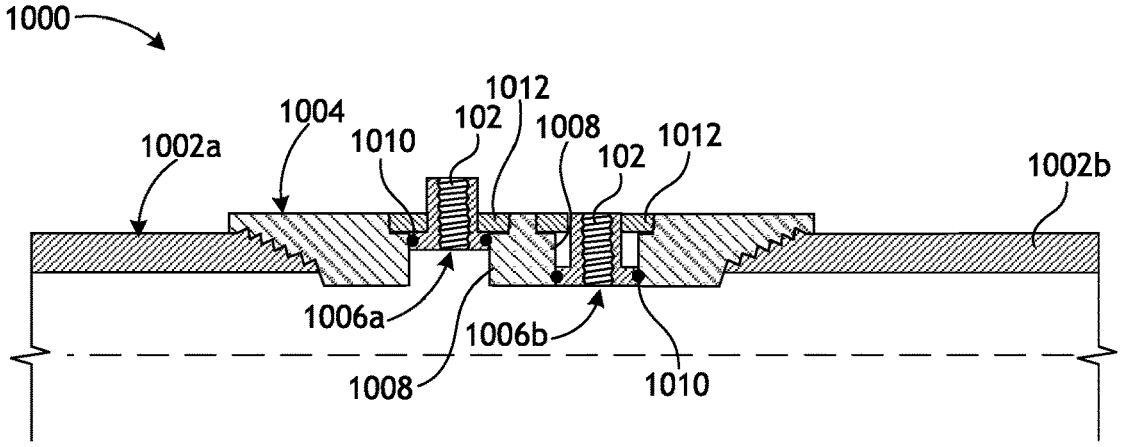
FIG. 10 is a cross-sectional side view of another example completion assembly, according to one or more additional embodiments.

FIG. 10 depicts a cross-sectional side view of another example completion assembly 1000, according to one or more embodiments. As illustrated, the completion assembly (hereafter the "assembly 1000") includes an upper liner 1002*a*, a lower liner 1002*b*, and a wellbore completion component 1004 that interposes and connects the upper and lower liners 1002*a,b*. In the illustrated embodiment, the wellbore completion component 1004 comprises a coupling that threadably couples the lower liner 1002*b* to the upper liner 1002*a*.

The assembly 1000 also includes one or more telescoping pistons, shown as a first telescoping piston 1006*a* and a second telescoping piston 1006*b*. Each telescoping piston 1006*a,b* may be movably attached to the wellbore completion component 1004, and each may include a dissolvable pipe plug 102 threaded therein. Each telescoping piston 1006*a,b* may sealingly engage a corresponding piston bore 1008 defined in the wellbore completion component 1004 with one or more seals 1010, such as an O-ring, a T-seal, or similar seals commonly found in the oilfield industry. In some embodiments, a retainer ring 1012 may be threadably engaged to the wellbore completion component 1004. The pistons 1006*a,b* may be assembled in the retracted position and held in place by a shear mechanism (not shown) connected to the retainer ring 1012.

In operation, the pistons 1006*a,b* may be configured to extend (telescope) when the wiper plug 410 (FIG. 4) locates the float shoe 302 (FIG. 3) and the fluid pressure within the system increases. In some embodiments, one or both of the pistons 1006*a,b* may be spring biased to the closed position, and the increased fluid pressure overcomes the spring bias to extend the pistons 1006*a,b*. In other embodiments, or in addition thereto, one or both of the pistons 1006*a,b* may be secured in the closed position with a shear ring (not shown) or the like, and the increased fluid pressure causes the shear ring to fail and allows the pistons 1006*a,b* to extend. In one or more embodiments, upon extending the pistons 1006*a,b* may be held in the extended position with a catch or the like.

The extended pistons 1006*a,b* contact the inner wall of the surrounding formation 408 (FIG. 4), and the dissolvable pipe plugs 102 begin dissolving when exposed to the spacer fluid 412 (FIG. 4). The cement 406 (FIG. 4) will harden in about 4-8 hours and up to about 24 hours, and the dissolvable pipe plugs 102 will dissolve in 24 to 48 hours, depending on the material alloy used. The pistons 1006*a,b* in the extended position will provide a pathway through the cement 406 to the formation 408 when the dissolvable pipe plugs 102 dissolve.

Figure 11:
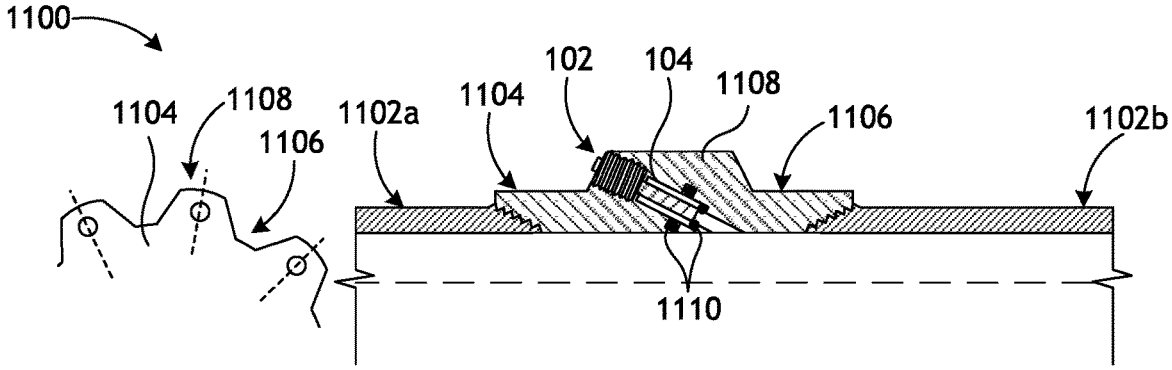
FIG. 11 is a cross-sectional side view of another example completion assembly, according to one or more additional embodiments.

FIG. 11 depicts an end view (left) and a cross-sectional side view (right) of another example completion assembly 1100, according to one or more embodiments. As illustrated, the completion assembly (hereafter the "assembly 1100") includes an upper liner 1102*a*, a lower liner 1102*b*, and a wellbore completion component 1104 that interposes the upper and lower liners 1102*a,b*. In the illustrated embodiment, the wellbore completion component 1104 comprises a ribbed sub coupling that threadably couples the lower liner 1102*b* to the upper liner 102*a*.

The wellbore completion component 1104 defines a plurality of cutouts 1106 that interpose ribs 1108, similar to a solid centralizer or spirolizer, as is known in the oil and gas industry. The cutouts 1106 may prove advantageous in allowing the cement 406 (FIG. 4) flow past the wellbore completion component 1104 on the outer surface.

The assembly 1100 also includes a dissolvable pipe plug 102 threaded into the wellbore completion component 1104. In the illustrated embodiment, the pipe plug 102 extends at an angle relative to the centerline of the wellbore completion component 1104. In other embodiments, however, the pipe plug 102 may extend vertically or otherwise perpendicular to the centerline of the wellbore completion component 1104, without departing from the scope of the disclosure. In some embodiments, the wellbore completion component 1104 may comprise pipe with a sidewall thick enough to accommodate the pipe plug 102, either vertically or at an angle.

In the illustrated embodiment, the pipe plug 102 has a threaded portion and an unthreaded shaft portion referred to as a "nose." The threaded portion of the pipe plug 102 is threadably received within the aperture 104, and one or more seals 1110 generate a seal against the unthreaded shaft and an unthreaded portion of the aperture 104. The seals 1110 may comprises, for example, O-rings or T-seals. In some embodiments, the threaded portion of the pipe plug 102 may include a corrosion barrier, such as Loctite or TEFLON® tape.

The elongated pipe plug 102 may be used when a longer time for dissolving is needed in harsh wellbore environments or when more time is needed for a more complex completion operation. More specifically, the dissolvable pipe plug 102 may begin dissolving when exposed to the spacer fluid 412 (FIG. 4). The cement 406 (FIG. 4) will harden in about 4-8 hours and up to about 24 hours, and the elongated dissolvable pipe plug 102 will dissolve with a much longer lead time, depending on the material alloy used and the length of the unthreaded shaft. The longer pipe plug 102 allows for extended dissolving times at harsher environments, such as higher temperatures. The plug 102 may be designed to dissolve in three stages: 1) Face seal 1110 isolates the shaft until the plug face erodes past the seal 1110, 2) the threaded end begins to erode with when in contact with an electrolyte such as cement, 3) the middle portion is protected between the sealing thread and the face seal 1110. The pipe plug 102 may be viable until the tubing fluid erodes the shaft past the seals 1110.

Figure 12:
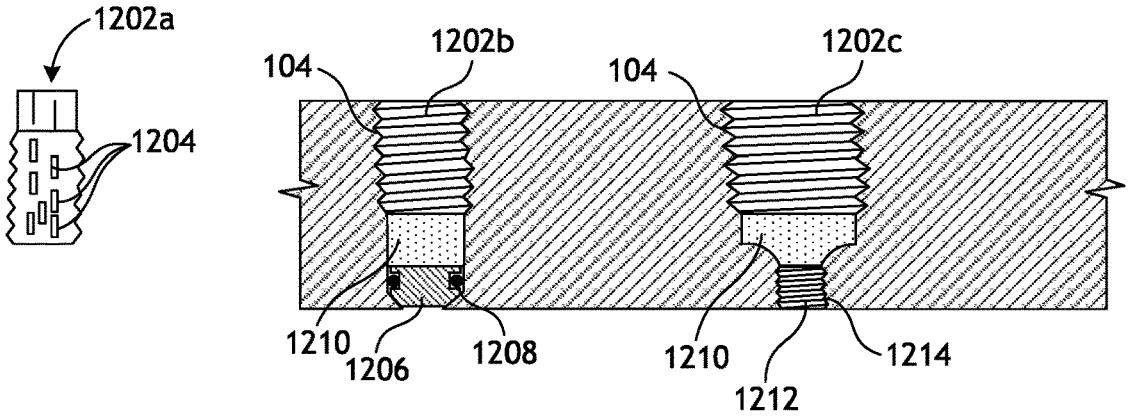
FIG. 12 depicts various embodiments of pipe plugs, according to one or more embodiments.

FIG. 12 depicts various embodiments of pipe plugs. More specifically, FIG. 12 depicts dissolvable pipe plugs 1202*a*, 1202*b*, and 1202*c*, and at least a portion of each pipe plug 1202*a-c* may be of any of the dissolvable materials mentioned herein. The first pipe plug 1202*a* may include one or more mechanical tags 1204 molded into the dissolvable material. The tags 1204 can be made of a buoyant material such as thermoplastic, an RFID device, or a similar material that is lighter than brine. The tags 1204 are released when the material of the first pipe plug 1202*a* dissolves, and the tags 1204 are subsequently recovered at surface from a filter or shaker or otherwise detected with suitable sensors.

The second dissolvable pipe plug 1202*b* is threaded into the aperture 104 along with a dissolvable insert 1206. The dissolvable insert 1206 may be arranged within a polished bore section of the aperture 104 and may be sealed against the polished bore with one or more seals 1208. A chemical tracer 1210 may interpose the second pipe plug 1202*b* and the dissolvable insert 1206, and the chemical tracer 1210 may be released when the pipe plug 1202*b* or the dissolvable insert 1206 dissolves or loses pressure integrity. Suitable tracers include dyes (such as phenoxazone dyes, fluroescein, pyridinium betaines dyes, solvatochromatic dyes, Oregon Green, Cascade Blue, Lucifer yellow, Auramine O, tetramethylrhodamine, pysranine, sulforhodamines, hydroxycoumarins; polysulfonated pyrenes; cyanines, hydroxylamines, neutral red, acridine orange), gases (such as helium and carbon dioxide); acids (such as picric acid and salicylic acid) or salts thereof; ionizable compounds (such as those which provide ammonium, boron, chromate, etc., ions); and radioactive materials (such as krypton-85); isotopes; genetically or biologically coded materials; microorganisms; minerals; and high molecular weight synthetic and natural compounds and polymers (such as oligonucleotides, perfluorinated hydrocarbons like perfluoro butane, perfluoro methyl cyclopentane and perfluoro methyl cyclohexane).

The third dissolvable pipe plug 1202*c* is threaded into the aperture 104 and a smaller dissolvable pipe plug 1212 may be threaded into a smaller aperture 1214 contiguous with and extending from the aperture 104. The chemical tracer 1210 may interpose the third dissolvable pipe plug 1202*c* and the smaller dissolvable pipe plug 1212, and the chemical tracer 1210 may be released when the third pipe plug 1202*c* or the smaller dissolvable pipe plug 1212 dissolves or loses pressure integrity. The chemical tracer 1210 may be a solid, liquid, gel, or powder that will dissolve in the water-based fluid that dissolves the dissolvable pipe plugs 1202*a-c*. The tracer material 1210 is then flowed to surface where surface equipment will detect the tracer 1210. Tracer technology can confirm that a plug has dissolved, and multiple unique tracer chemicals can determine which or how many of the plugs have dissolved.

Embodiments disclosed herein include:

A. A completion assembly that includes an upper liner and a lower liner, a wellbore completion component that interposes the upper and lower liners, a dissolvable pipe plug threaded into the wellbore completion component, and a dissolvable projectile seat arranged adjacent the wellbore completion component.

B. A completion assembly that includes an upper liner and a lower liner, a wellbore completion component that interposes the upper and lower liners, a dissolvable pipe plug threaded into the wellbore completion component, and a shield coupled to the wellbore completion component and radially aligned with the dissolvable pipe plug.

C. A completion assembly that includes an upper liner and a lower liner, a wellbore completion component that interposes the upper and lower liners and defines an aperture, and a dissolvable pipe plug received within the aperture and including a threaded portion and a non-threaded shaft extending from the threaded portion, wherein the threaded portion is threaded into the aperture, and the non-threaded shaft is sealed against an unthreaded portion of the aperture.

Each of embodiments A, B, and C may have one or more of the following additional elements in any combination: Element 1: wherein the pipe plug and the projectile seat are each made of a dissolvable material selected from the group consisting of a dissolvable metal, a galvanically-corrodible metal, a degradable polymer, a degradable rubber, borate glass, polyglycolic acid, polylactic acid, a dehydrated salt, and any combination thereof. Element 2: wherein the pipe plug is made from two or more dissimilar metals capable of undergoing independent galvanic corrosion. Element 3: wherein the pipe plug is made of a first galvanically-corrodible metal and the wellbore completion component is made of a second galvanically-corrodible metal that forms a galvanic pair with the first galvanically-corrodible metal. Element 4: wherein the projectile seat is provided on a sliding sleeve and the pipe plug extends at least partially through the sliding sleeve to hold the sliding sleeve in a first position until the pipe plug dissolves. Element 5: further comprising a dissolvable wellbore projectile deployable into the completion assembly and engageable with the sliding sleeve to move the sliding sleeve to a second position after the pipe plug dissolves. Element 6: wherein the wellbore completion component comprises a pup-joint, the completion assembly further comprising an upper coupling that threadably couples the upper liner to the pup-joint, and a lower coupling that threadably couples the lower liner to the pup-joint, wherein the projectile seat is defined on at least one of the upper and lower couplings. Element 7: wherein the dissolvable pipe plug is a first dissolvable pipe plug and the completion assembly further comprises a second dissolvable pipe plug threaded through the upper coupling or the lower coupling, and wherein the second dissolvable pipe plug is longer than the first dissolvable pipe plug. Element 8: further comprising a dissolvable wellbore projectile deployable into the completion assembly to engage the projectile seat on the at least one of the upper and lower couplings. Element 9: wherein the wellbore completion component comprises a coupling that threadably couples the lower liner to the upper liner, the completion assembly further comprising a dissolvable threaded fastener that secures the projectile seat to the wellbore completion component.

Element 10: wherein the pipe plug is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof. Element 11: wherein the pipe plug is made from two or more dissimilar metals capable of undergoing independent galvanic corrosion. Element 12: wherein the pipe plug is made of a first galvanically-corrodible metal and the wellbore completion component is made of a second galvanically-corrodible metal that forms a galvanic pair with the first galvanically-corrodible metal. Element 13: wherein the wellbore completion component comprises a ribbed sub coupling that threadably couples the lower liner to the upper liner. Element 14: wherein the shield is coupled to the wellbore completion component by at least one of threading, welding, press-fitting, gluing, and any combination thereof. Element 15: further comprising a tracer material disposed within a gap defined between the shield and the dissolvable pipe plug.

Element 16: wherein the pipe plug is made of a dissolvable material selected from the group consisting of a dissolvable metal, a galvanically-corrodible metals, a degradable polymer, a degradable rubber, borate glass, polyglycolic acid, polylactic acid, a dehydrated salt, and any combination thereof. Element 17: wherein two or more seals interpose the non-threaded shaft and the unthreaded portion of the aperture.

By way of non-limiting example, exemplary combinations applicable to A, B, and C include: Element 4 with Element 5; Element 6 with Element 7; Element 6 with Element 8; and Element 14 with Element 15.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A completion assembly, comprising:

an upper liner and a lower liner;

a wellbore completion component that interposes the upper and lower liners;

a first dissolvable pipe plug secured within an aperture defined in the wellbore completion component;

an upper coupling internally threaded at opposing ends and threadably coupling the upper liner to the wellbore completion component; and a lower coupling internally threaded at opposing ends and threadably coupling the lower liner to the wellbore completion component;

a second dissolvable pipe plug threaded through one of the upper or lower couplings, the second dissolvable pipe plug being longer than the first dissolvable pipe plug; and a projectile seat defined on at least one of the upper and lower couplings.

2. The completion assembly of claim 1, wherein at least one of the first and second pipe plugs and the projectile seat is made of a dissolvable material selected from the group consisting of a dissolvable metal, a galvanically-corrodible metal, a degradable polymer, a degradable rubber, borate glass, polyglycolic acid, polylactic acid, a dehydrated salt, and any combination thereof.

3. The completion assembly of claim 1, wherein one or both of the first and second pipe plugs is made from two or more dissimilar metals capable of undergoing independent galvanic corrosion.

4. The completion assembly of claim 1, wherein one or both of the first and second pipe plugs is made of a first galvanically-corrodible metal and the wellbore completion component is made of a second galvanically-corrodible metal that forms a galvanic pair with the first galvanically-corrodible metal.

5. The completion assembly of claim 1, wherein one or both of the first and second pipe plugs is recessed from an inner surface of the wellbore completion component within the aperture and thereby defining a cavity between an end of the one or both of the first and second pipe plugs and the inner surface, the completion assembly further comprising a filler material positioned within the cavity.

6. The completion assembly of claim 5, wherein the filler material is dissolvable in the presence of a cement slurry or a spacer fluid, but not in the presence of an oil-based drilling fluid.

7. The completion assembly of claim 1, further comprising a dissolvable wellbore projectile deployable into the completion assembly to engage the projectile seat on the at least one of the upper and lower couplings.

8. The completion assembly of claim 1, wherein the first dissolvable pipe plug is secured within the aperture by at least one of threading, an interference fit, a shrink fit, an adhesive, welding, brazing, and any combination thereof.

9. The completion assembly of claim 1, further comprising a telescoping piston movably attached to the wellbore completion component, wherein the first dissolvable pipe plug is secured to the telescoping piston.

10. The completion assembly of claim 1, further comprising a mechanical tag molded into the first dissolvable pipe plug.

11. The completion assembly of claim 1, wherein a first portion of the aperture is threaded and a second portion of the aperture is non-threaded, and wherein first the dissolvable pipe plug is threaded into the first portion and the completion assembly further comprises:

a dissolvable insert arranged within the non-threaded portion; and a chemical tracer interposing the first dissolvable pipe plug and the dissolvable insert.

12. The completion assembly of claim 1, wherein the aperture defines a first portion and a second portion contiguous with and smaller than the first portion, and wherein the first dissolvable pipe plug is a first dissolvable pipe plug arranged in the first portion, the completion assembly further comprising:

a second dissolvable pipe plug arranged in the second portion; and a chemical tracer positioned within the aperture and interposing the first and second dissolvable pipe plugs arranged in the first and second portions.

13. The completion assembly of claim 1, wherein the projectile seat is defined on the upper coupling and located uphole from the first dissolvable pipe plug.

* * * * *